United States Patent [19]

Parker

[11] 4,230,364

[45] Oct. 28, 1980

[54] MULTIPURPOSE CHAIR

[76] Inventor: Charles F. Parker, 2041 Tevis Ave., Long Beach, Calif. 90815

[21] Appl. No.: 895,813

[22] Filed: Apr. 12, 1978

[51] Int. Cl.[2] ..... A47C 7/00; A47C 31/00

[52] U.S. Cl. ..... 297/468; 4/560; 297/441; 297/DIG. 2

[58] Field of Search ..... 4/185 R, 185 AB, 185 B, 4/185 S, 185 HB; 297/385, 441, 440, 443, DIG. 2; 248/206 R

[56] References Cited

U.S. PATENT DOCUMENTS

| | | | |
|---|---|---|---|
| 2,145,669 | 1/1929 | Thompson | 297/218 |
| 2,460,699 | 2/1949 | Long | 211/182 X |
| 2,463,049 | 3/1949 | Onsa | 4/185 R |
| 2,564,915 | 8/1951 | Nelson | 297/441 X |
| 2,647,561 | 8/1953 | Szabo | 4/185 B |
| 2,742,956 | 4/1956 | Cannata | 297/440 X |
| 3,235,306 | 2/1966 | Chernivsky | 4/185 B |
| 3,380,776 | 4/1968 | Dillender | 297/385 X |
| 3,538,522 | 11/1970 | Adams | 297/441 X |
| 3,695,702 | 10/1972 | Ingellis | 297/441 |
| 3,784,254 | 1/1974 | Longato | 297/DIG. 2 |

*Primary Examiner*—James T. McCall

[57] ABSTRACT

A chair is constructed of water insensitive materials and is used in position on a smooth surfaced floor such as a linoleum floor, a hardwood floor or the floor of a bath tub or wading pool. The chair includes front legs which are equipped with suction cups to immobilize the chair, and inclined back support rails. The chair includes a flexible porous webbing which supports a seated occupant in a supine position with thighs upwardly and forwardly inclined and with buttocks located just above the surface of the floor.

9 Claims, 7 Drawing Figures

MULTIPURPOSE CHAIR

BACKGROUND OF THE INVENTION

1. Field of the Invention

The present invention relates to seating accessories, and especially to devices for supporting persons in a seated position on hard surfaces, including seating supports in bathing water.

2. Description of the Prior Art

A need has heretofore existed for a multipurpose chair which provides a safe support for seating on hard smooth surfaces. The chair can be used as a seating device on virtually any type of smooth surfaced floor including hardwood floors, linoleum floors, and also light tectured tile floors. In its most desirable application, the suction cups form a vacuum seal with the floor or other surface upon which the chair is positioned, although this is not absolutely necessary. For example, the chair finds additional application for use as a seating device in sand, such as at a beach. In this use, the suction feet of the chair tend to provide support to keep the front legs from sinking into the sand. Also, the rear cross bar provides a sufficiently broad area of support to keep the back legs from sinking into the sand.

The chair of the invention also finds significant utility when used as a positioning chair for handicapped children in a classroom situation. In many instances handicapped children have been unable to participate with children having full physical mobility who are gathered around a teacher and seated on the floor or upon a rug. By using the chair of the present invention, a physcially handicapped child can be seated in a low reclining position, quite near to the surface upon which the other children in the class are seated. The handicapped child is thereby not separated from the other children and is placed in the midst of the group, rather than apart or at a higher level than the other children. By being positioned as an equal in the group, the handicapped child acquires a sense of participation and belonging in the group. Also, the other children are not forced to look up in order to talk to the handicapped child, as is the case when the handicapped child is seated in a conventional chair. This physical separation has been a major barrier to communication between children having full physical mobility and handicapped children.

The chair of the invention also has a unique use as a device to facilitate the bathing of physically disadvantaged persons by others in conventional bathing areas. Small portable bath tubs have been utilized to bathe babies for many years and have been available in a variety of configurations. For example, commercially available portable bath tubs for babies have been of elongated form and constructed of plastic. Such a tub is filled with water to a shallow depth and rested upon some convenient surface, such as a kitchen counter or table. A baby may be placed in the tub and bathed, and the bath water thereafter disposed of in a kitchen sink or down the drain of a conventional adult size bath tube or shower. However, such portable path tubs are not at all stable, and a constant guard must be maintained to prevent over-turning and also to prevent the baby from turning its head into the bath water and choking. Violent eratic moments of a baby, such as frequently occur during bathing as a result of joy, rage or distress create a substantial danger of overturning the portable tub. If this happens, the baby is quite likely to fall a considerable distance, since such portable tubs are generally utilized on kitchen sinks, tables and other supports at heights of three feet or more.

Currently, portable bathing aids for use by persons above the infant stage are unavailable. When a child reaches an age or size at which bathing in portable bath tubs designed for infants presents unacceptable risks of injury, the portable bath tubs are no longer used and bathing must be carried out in full size bath tubs. This is extremely fatiguing to the mother or guardian of a small child since, without any constraints on movement, the bathing of the child becomes extremely difficult. Moreover, additional hazards are presented since, through inexperience, the child's movements on slippery porcelain surfaces can lead to serious injury. All too frequently, young children attempt to stand or climb in hence are injured.

The dangers in conventional bathing techniques for physically disadvantaged persons are magnified many times in the case of physically or mentally retarded children. In bathing such children, the difficulties in bathing children of a larger size are compounded with those which exist in bathing helpless individuals, such as infants. When such a person must be washed in a bath tub or bathing pool by another, bathing becomes an extremely emotionally and physically fatiguing experience for the person charged with the responsibility of washing the physically or mentally disadvantaged person. Frequently, the only practical way of accomplishing this task is for the mother to enter the bath tub with the child because of the physical strength that is otherwise involved.

SUMMARY OF THE INVENTION

The present invention provides a seating device which will safely support an occupant on a rigid, hard floor surface. Because of the physical configuration of the chair and the suction cup feet on the front legs, an individual seated in the chair on a hard floor surface is much less likely to inadvertently cause the chair to slip or tip over, and thus cause injury. In contrast, conventional chairs with straight legs and narrow feet may easily be tipped, especially on hard, slippery surfaces. A chair of the present invention, however, can be safely and releasably fastened to such a surface by means of the suction cup feet on the lower extremities of the front chair legs. Moreover, with the chair of the invention designed according to its preferred configuration, with an elongated back support and a seating arrangement close to the floor surface, it is quite difficult for the chair to tip backwards. Even when forced rearward in a tilt about the rear legs of the chair with the front legs rising from the surface, the center of gravity will not pass to the rear of the rear legs until the extremities of the back support are within about 2½ inches of the floor surface. This means that an uncontrolled fall or rearward tipping of the chair can occur only through a distance of about 2½ inches, greatly reducing the possibilities of physical harm to the chair occupant.

It is another object of the present invention to provide an aid for bathing a physically or mentally disadvantaged person in a conventional bathing area while minimizing the dangers and disadvantages that have heretofore existed. A chair is provided which may be positioned on the floor of a bathing area so as to constrain the movements of the individual being bathed and at the same time support that individual in a manner which both facilitates bathing and enhances the safety of the person being bathed. The chair is provided with a pair of suction devices on the front legs thereof so as to anchor the chair to the bathing area floor and thereby improve its natural stability. In addition, the chair of the invention is equipped with inclined back support rails oriented at an angle to elevate the head of an individual seated therein slightly, yet maintain that person in a supine position. The person's head is supported by webbing extending between the back support rails. This minimizes the likelihood of a person rising from the chair and falling, since by being seated in a supine position, a major portion of the body weight of the individual acts to maintain that person in a reclined seated position. Moreover, because of the construction of the chair of the invention, when a person assumes a reclined seated position, the thighs of that individual are naturally raised upwardly and forwardly and the person's lower legs reside in a position in which it becomes extremely difficult for that person to arise from the chair unaided. At the same time, however, the head of the person seated in the chair is maintained at a sufficient elevation to be safely out of the bath water and is fully supported between the back support rails. It has been found that the chair of the invention has a calming effect on hyperactive children and provides a stimulating effect on lethargic children. Bathing thereby becomes a more pleasant experience, not only for the person being bathed, but especially for the person performing the actual washing activity.

Not only does the chair of the present invention provide a distinctly advantageous aid for physically and mentally disadvantaged children, but it is equally useful for bathing infants or for bathing adults having physical or mental deficiencies. In this connection, the chair of the invention is particularly useful not only for bathing elderly invalids, but also for bathing paraplegics, quadraplegics and amputees. In forms of the chair of the invention designed for older children or adults, the back support rails which are oriented at an incline relative to the bathing area floor, are reinforced by braces to enhance the rigidity of the supine support provided by the back support rails.

As previously noted, the invention has a great many uses other than as a bath chair. The front legs of the chair are equipped with suction cups designed to adhere to any type of hard, smooth surfaced floor. The chair is also quite suitable for other uses. It may be positioned on the sand, in a yard, patio or other area and arranged in the vicinity of more conventional chairs to allow the child or other occupant to remain in the company of others. Furthermore, because of the reclined seating provided by the chair, it is especially suitable for use in viewing television. The chair is light in weight and may easily be moved about a home and serve a variety of different purposes at different times. Because of its versatility, the chair presents minimal storage problems but rather becomes a versatile item of furniture.

An optional feature of the invention involves the provision of restraining straps. Such straps may take the form of a single strap attached to the back support rails, side rails or front legs, or a pair of straps may be attached on either side and joined together in front of the seated individual. While a buckle arrangement may be employed to join the ends of the straps, such an arrangement is generally not particularly desirable since when the chair is wet, the straps tend to either slip through the buckle or bind therein. Rather, a preferred form of attaching the ends of the straps is by means of opposing velcro pads located on either strap end. Each velcro pad comprises a multiplicity of severed plastic loops or hooks which, when pressed in contact with each other, readily engage and fasten the strap ends together. When disengagement is desired, the strap ends are merely pulled apart, thereby disengaging the resilient plastic hooks from each other. The hooks resume their normal shape following disengagement and are ready for subsequent use.

When straps are employed, they may be centrally secured relative to the back support rails to hold the upper torso of the seat occupant reclined as far as possible in the seat webbing. Alternatively, the straps may be secured proximate to the lower extremities of the side rails to immobilize the hip area of the seat occupant. When secured across the upper extremities of the front leg of the chair, a strap serves a very useful function of limiting the extent to which a chair occupant is able to raise his knees. This inhibits the seated person from exerting pressure with his feet normal to the floor, and thereby reduces the risk that the chair occupant may inadverently push the chair over backwards or topple it sideways. Also, the chair occupant is inhibited from rising from the chair and possibly falling on a hard floor surface.

Preferably, the webbing of the chair is constructed and attached to the chair framework so that it provides a minimum clearance at its lowest portions above the floor surface when an occupant is seated therein. This tends to maintain the center of gravity of the seated individual as low as possible in the chair and thereby enhance stability of the chair. Furthermore, by being positioned as close as possible to the floor of a bathing area, the amount of water required for bathing is minimized. When the bathing area is filled to only a shallow level, partial immersion is still achieved.

DESCRIPTION OF THE EMBODIMENTS

Figure 1:
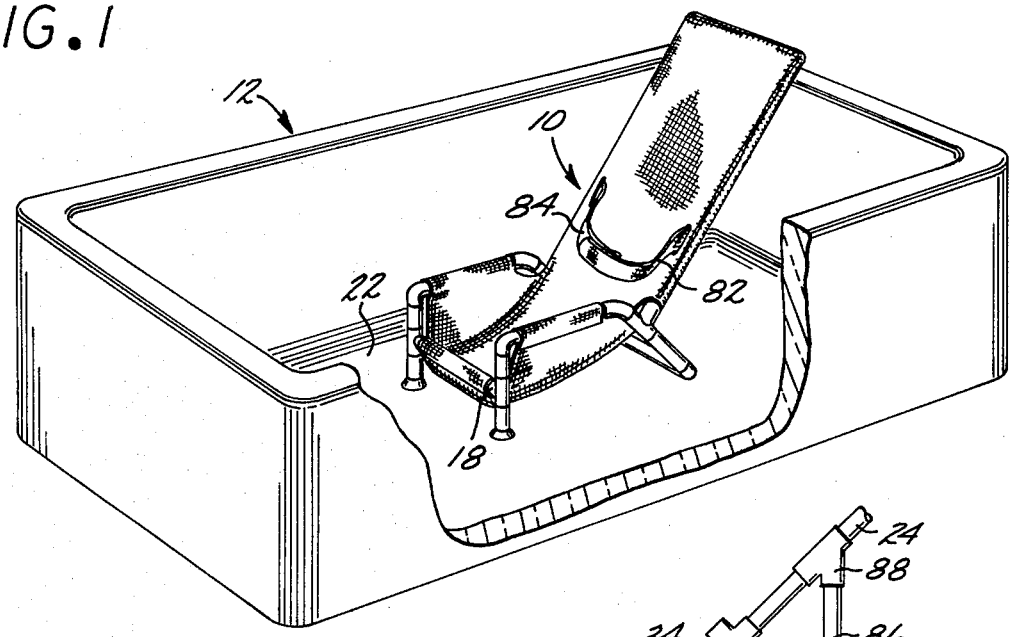
FIG. 1 is a perspective view showing the chair of the invention in position on the floor of a bath tub while being used as a bath chair.
Figure 2:
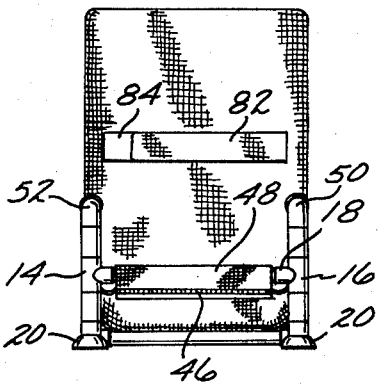
FIG. 2 is a front elevational view of the chair of the invention.
Figure 3:
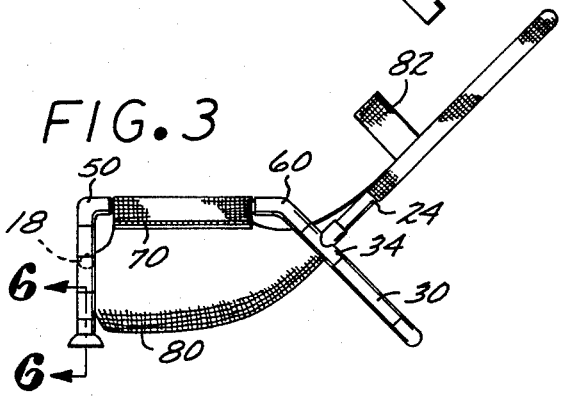
FIG. 3 is a side elevational view of the chair of the invention.
Figure 4:
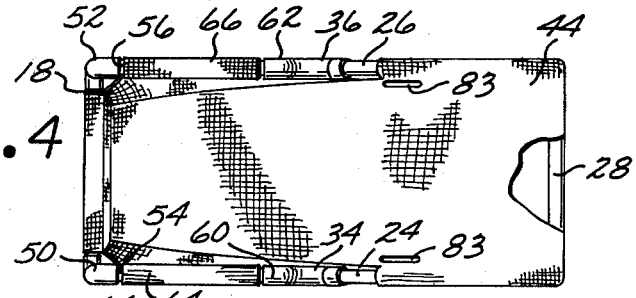
FIG. 4 is a top plan view of the chair of the invention.
Figure 5:
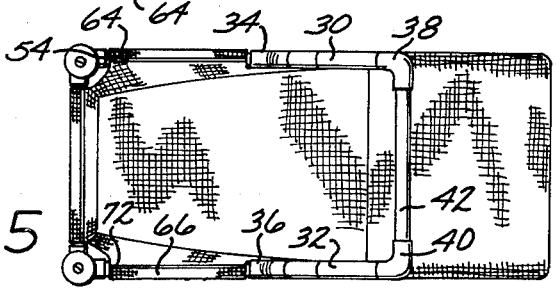
FIG. 5 is a bottom plan view of the chair of the invention.

A portable chair 10 constructed of water insensitive materials is depicted in position in a bath tub 12 in FIG. 1. The framework of the chair 10 is constructed of ¾ inch diameter rigid, hollow plastic tubing attached by solvent welds. In an alternative construction, the chair can be molded of plastic and formed in an eight cavity mold. With either type of construction the chair framework has a pair of vertically oriented front legs 14 and 16 joined together by a transverse front cross bar 18 as illustrated in FIG. 2. The lower extremities, or feet of the front legs 14 and 16 are equipped with concave suction cups 20 for vacuum adhesion to the bath tub floor 22. As illustrated in FIGS. 3 and 4 a pair of upwardly and rearwardly inclined back support rails 24 and 26 are oriented at an angle relative to the bath tub floor 22 and terminate at their upper extremities remote from the front legs 14 and 16 where they are joined together by a transverse cross bar 28, partially visible in FIG. 4.

As is apparent from FIG. 3, the orientation of the back support rails 24 is such that the chair provides supine back support to comfortably accommodate an individual reclining in the chair 10. Rear support is provided by a pair of rear legs 30 and 32 which are connected to the back support rails 24 and 25 by T-shaped tubular junction pieces 34 and 36. The rear legs 30 and 32 extend downwardly and rearwardly to the bath tub floor 22 from the junction pieces 34 and 36 where they join the lower extremities of the back support rails 24 and 26. The lower extremities of the rear legs 30 and 32 terminate in inwardly turned hollow elbows 38 and 40 which accommodate an intermediate cross bar 42 that joins the rear legs 30 and 32 together adjacent to the floor 22 of the bath tub 12.

A flexible porous sheet of webbing 44, preferably constructed with a polyester core and reinforced with vinyl, extends between the transverse front and rear cross bars 18 and 28 respectively and across the expanse between the back support rails 24 and 26 and across a seating area where it closely approaches the bath tub floor 22 just to the rear of the front legs 14 and 16. At one end the webbing 44 is folded over upon itself and sewn along its edges in a double stitch seam to form a rear pocket which fits over the rear cross bar 28 and over the elevated rearward portions of the back support rails 24 and 26. The front of the webbing 44 terminates in a flap 48, the forward portion of which is folded over to encircle the front cross bar 18. A zipper is provided at 46 to secure the webbing 44 to the front cross bar 18. One portion of the zipper is sewn into the underside of the webbing 44 proximate to the flap 48. The other portion of the zipper is sewn to the forward edge of the flap 48. The two mating portions of the zipper are secured together using a conventional zipper slide constructed of water insensitive material, such as nylon.

The upper extremities of the front legs 14 and 16 terminate in rearwardly directed elbows 50 and 52, which in turn receive horizontal longitudinally directed tubular side support rails 54 and 56. The side rails 54 and 56 extend forwardly from the rear support legs 30 and 32 above the level of the forward cross bar 18 and are joined to the rear legs 30 and 32 by means of 45° elbows 60 and 62. By means of short segments of plastic tubing, the elbows 60 and 62 are connected to the T-shaped junction pieces 34 and 36. Side flaps 64 and 66 of the webbing 44 encircle the central portions of the longitudinal side rails 54 and 56 and are fastened by zippers at 70 and 72 in the manner described in conjunction with the forward flap 48. The webbing 44 thereby extends longitudinally from between the front and rear cross bars 18 and 28 and laterally between the back support rails 24 and 26 and between the side rails 54 and 56 which serve as lateral hip restraints. By disengaging the zippers 46, 70 and 72, the webbing 44 can be removed from the chair framework for repair, replacement or cleaning.

Figure 6:
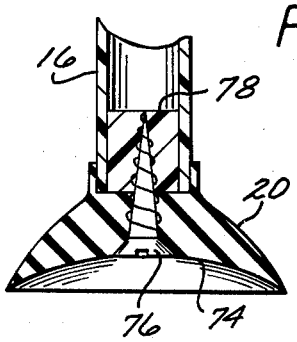
FIG. 6 is an enlarged sectional view taken along the lines 6—6 of FIG. 3.

The construction of the suction cups 20 is depicted in detail in FIG. 6. Each suction cup 20 includes a concave undersurface 74 having a circular perimeter three inches in diameter. A machine nut 92 is formed into the rubber cup 20 a distance above the undersurface 74 and below the surface of an upper cylindrical extremity 91 of the cup 20. A two inch bolt hanger having an upper portion 76, threaded as a wood screw, and a lower portion 77, threaded as a machine screw, is directed vertically upward from the cylindrical extremity 91 into a solid cylindrical core 78 which is solvent welded within the lower extremities of the front legs 14 and 16. The lower portion 77 of the bolt hanger is engaged by the nut 92 by rotating the cup 20 clockwise, as viewed from beneath, until the shoulder of the upper surface of the cup 20 seats against the lower extremity of the front leg 14 or 16 to which the cup 20 is attached. The suction cups 20 are thereby removably attached to the front legs 14 and 16 are so that they may be replaced when necessary by counterclockwise rotation to disengage the lower portion 77 of the bolt hanger from the nut 91. Suction cups can thereby be removed and replaced. Also, the suction cups 20 can be utilized to level the front legs of the chair by threadably engaging the portions 77 of the bolt hangers with the nuts 92 to a selected degree short of total engagement.

As may be noted by reference to FIGS. 2 and 3, the front cross bar 18 is located as low as possible along the upward extent of the legs 14 and 16 while still holding the webbing 44 above the bathing area floor when supporting a seated occupant in a supine, reclined position. The lowest part 80 of the webbing 44 just clears the floor of the bath tub 22 so that a minimum amount of water is required to partially immerse the occupant of the chair 10 and so that the center of gravity of the seated individual is kept as low as possible.

It is sometimes desirable to provide restraining straps, such as the straps 82 and 84 depicted in FIGS. 1-3. These straps are mounted respectively on back support rails 24 and 26. Each of the straps 82 and 84 terminates in a plastic D-shaped ring. Each strap is looped about a separate one of the back support rails 24 and 26 and passed through the D-shaped ring so that it is secured to the chair 10. The free ends of the straps are passed through apertures 83 in the webbing 44 and are equipped with velcro pads, so that by positioning adjacent to each other, they may be fastened together. While the straps 82 and 84 are depicted at intermediate positions along the back support rails 24 and 26, it is also possible for straps to be similarly positioned in the vicinity of the hip area at the 45° elbows 60 and 62, or alternatively above the legs of a seated individual by attachment to the 90° elbows 50 and 52 at the upper extremities of the legs 14 and 16. The safety straps 82 and 84, when positioned along the back support rails 24 and 26 as depicted in FIG. 1, serve to hold the upper torso of a seated indivudal in place and to hold the individual in a supine position. Straps at the rearward extremities of the side support rails 54 and 56 immobilize the hips of a chair occupant while straps attached to the elbows 50 and 52 limit the upward movement of the legs or knees of a chair occupant.

Figure 7:
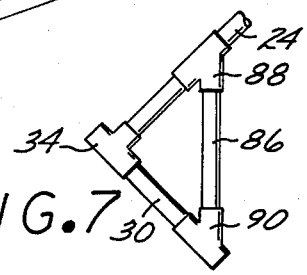
FIG. 7 is a side elevational view of an isolated portion of a modified form of the chair of the invention.

A modification of the invention is depicted in FIG. 7 for use with larger embodiments of the chair of the invention designed for adults or larger children. A pair of back support braces, one of which is depicted at 86 in FIG. 7, connect the rear legs 30 and 32 of the chair 10 with the back support rails thereof at locations remote from the T-shaped pieces 34 and 36. Forty five degree junction pieces 88 and 90 are provided to serve respectively as sleeves for the back support rail 24 and the rear leg 30 depicted in FIG. 7. The angled sockets of the three way junction pieces 88 and 90 receive the ends of the back support brace 86. In this way, the degree of movement that is likely to occur at the upper extremities of the back support rails 24 and 26 is significantly reduced and the rigidity of the supine support provided by the chair 10 is enhanced. Excessive movement would otherwise result from the cantilever attachment of the back support rails 24 and 26 to the rear legs 30 and 32 at the T-shaped junction pieces 34 and 36.

It should be appreciated that various altered or modified forms of the chair of the invention may be constructed and configurations different from those depicted in the drawings may be preferred for different reasons. The invention should not, however, be considered as restricted to the particular forms of the invention or uses depicted in the accompanying drawings, however, but rather is broadly defined in the claims appended hereto.

I claim:

1. A portable chair constructed of water insensitive materials and having a pair of front legs joined by a transverse front cross bar and terminating in lower extremities equipped with suction devices for vacuum adhesion to a floor wherein said front cross bar is located well above the level of said floor, a pair of inclined back support rails joined together at extremities remote from said front legs by a transverse rear cross bar and oriented to provide supine back support, rear support means directly connected to said back support rails and providing rear support relative to said floor, side support rails that extend forwardly from said rear support means to said front legs above the level of said forward cross bar wherein said rails, said legs and said support means are all joined together in fixed immobile arrangement, and are constructed of short sections of hollow, plastic tubing, including joints formed by elbows and T-shaped sections, and a flexible porous sheet of webbing extending from said transverse front cross bar sharply downward to a level closely approaching said floor immediately behind said suction devices and from there upward and rearward to said rear cross bar and upward laterally to said side support rails.

2. The chair of claim 1 further characterized in that said rear support means comprises a pair of rear legs connected to said back support rails and extending downwardly and rearwardly from the extremities of said back support rails nearest said front legs, and joined together by an intermediate cross bar proximate to said area floor.

3. The chair of claim 2 further comprising a pair of back support braces interconnecting said rear support means and said back support rails at locations remote from the forward interconnection thereof to enhance the rigidity of supine support.

4. The chair of claim 1 further comprising safety strap means mounted at the rearward extremities of said side support rails to immobilize the hips of a chair occupant.

5. The chair of claim 1 further comprising safety strap means mounted on said back support rails for holding a chair occupant in a supine position.

6. The chair of claim 1 further comprising safety strap means mounted on said front legs and extending therebetween above said forward cross bar to limit the upward movement of the knees of a chair occupant.

7. The chair of claim 1 further characterized in that said webbing comprises a rear pocket which fits over said rear cross bar and over the rearward portions of said back support rails, and zipper means for releasably securing a flap of said webbing about said forward cross bar, whereby said webbing is removable from said rails, legs and support means.

8. The chair of claim 1 further characterized in that said webbing is constructed of webbing with a polyester core reinforced with nylon.

9. The chair of claim 1 further characterized in that said suction devices are removably attached to said front legs.

* * * * *